US011191313B2

(12) United States Patent
Meyer et al.

(10) Patent No.: US 11,191,313 B2
(45) Date of Patent: Dec. 7, 2021

(54) HATS AND ATTACHMENT SYSTEMS FOR USE WITH HATS

(71) Applicant: Buck Head Hats LLC, Mequon, WI (US)

(72) Inventors: Jesse Meyer, Mequon, WI (US); Marc Hunter Ownley, Greenfield, WI (US)

(73) Assignee: Buck Head Hats LLC, Mequon, WI (US)

( * ) Notice: Subject to any disclaimer, the term of this patent is extended or adjusted under 35 U.S.C. 154(b) by 57 days.

(21) Appl. No.: 16/536,836

(22) Filed: Aug. 9, 2019

(65) Prior Publication Data

US 2020/0046052 A1 Feb. 13, 2020

Related U.S. Application Data

(60) Provisional application No. 62/716,773, filed on Aug. 9, 2018.

(51) Int. Cl.
*A42B 1/004* (2021.01)
*A42B 1/24* (2021.01)

(52) U.S. Cl.
CPC ..... *A42B 1/004* (2013.01); *A42B 1/24* (2013.01)

(58) Field of Classification Search
CPC ..... A42B 1/002; A42B 1/004; A42B 1/24; A42B 1/242; A42B 1/244; A42B 1/245; A42B 1/247
See application file for complete search history.

(56) References Cited

U.S. PATENT DOCUMENTS

| | | | | |
|---|---|---|---|---|
| 3,381,308 | A | 5/1968 | Fineberg | |
| 5,903,925 | A | 5/1999 | Engebretson | |
| 6,094,749 | A * | 8/2000 | Proctor | A42B 1/004 2/171.1 |
| 6,279,167 | B1 * | 8/2001 | Johnson | A42B 1/004 2/209.11 |
| 6,519,779 | B1 | 2/2003 | Taguchi | |
| 7,114,198 | B1 | 10/2006 | Hsieh et al. | |
| D626,727 | S | 11/2010 | Landson et al. | |
| 8,209,782 | B1 | 7/2012 | Henry | |
| 8,763,163 | B1 * | 7/2014 | Johns | A42B 1/22 2/200.1 |
| 2007/0022514 | A1 | 2/2007 | Paulson | |
| 2019/0350289 | A1 * | 11/2019 | Jones | A42B 1/24 |

* cited by examiner

*Primary Examiner* — Sally Haden
(74) *Attorney, Agent, or Firm* — Andrus Intellectual Property Law, LLP

(57) ABSTRACT

A system for coupling an accessory to a hat having an interior surface and an opposite, exterior surface includes a brace configured to extend along the interior surface of the hat, a bracket configured to be positioned on the exterior surface of the hat, and a fastener configured to extend through the hat to thereby couple the bracket to the brace such that the accessory can be coupled to the bracket and thereby supported on the hat.

14 Claims, 10 Drawing Sheets

HATS AND ATTACHMENT SYSTEMS FOR USE WITH HATS

CROSS-REFERENCE TO RELATED APPLICATION

The present disclosure is based on and claims priority to U.S. Provisional Patent Application No. 62/716,773 filed Aug. 9, 2018, the disclosure of which is incorporated herein by reference.

FIELD

The present disclosure relates to hats and more specifically relates to attachment systems for attaching one or more accessories to hats.

BACKGROUND

Various types of hats, such as baseball hats and hardhats, are worn by people for a variety of reasons, such as sun protection, safety, and fashion. In addition, people add accessories to a hat to alter the appearance of the hat (e.g., such as adding patches), increase the functionality of the hat (e.g., adding lights), and/or increase the fashion of the hat (e.g., adding ornamental components such as ribbon bows). Furthermore, people who are fans of sporting teams may also add accessories to hats to show their support for their team.

People often seek to minimize the cost associated with adding accessories to a hat and often prefer systems that can be easily attached and detached from the hat and facilitate or permit easy attachment of accessories to the hat. An example of a conventional system for attaching accessories to hats is disclosed in U.S. Pat. No. 5,903,925, however, the system disclosed in U.S. Pat. No. 5,903,925 is not effective in securely supporting accessories on the hats.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In certain examples, a system for coupling an accessory to a hat having an interior surface and an opposite, exterior surface includes a brace configured to extend along the interior surface of the hat, a bracket configured to be positioned on the exterior surface of the hat, and a fastener configured to extend through the hat to thereby couple the bracket to the brace such that the accessory can be coupled to the bracket and thereby supported on the hat.

In certain examples, a hat to which as first accessory and a second accessory are coupled includes an interior surface that defines a cavity configured to receive a head of a user and an exterior surface opposite the interior surface. The interior surface is curved and configured to correspond to the head of the user. A first bracket is on and extends away from the exterior surface, and the first bracket is configured to couple to the first accessory. A second bracket is on and extends away from the exterior surface. The second bracket is spaced apart from the first bracket, wherein the second bracket is configured to couple to the second accessory. A brace positioned along the interior surface such that the brace is aligned with the first and second brackets. The brace is curved to correspond to the interior surface. A first fastener couples the brace to the first bracket, and a second fastener couples the brace to the second bracket In certain examples, a method for attaching an accessory to a hat includes the steps of positioning a brace along an interior surface of the hat, positioning a bracket on an exterior surface of the hat such that the bracket aligns with the brace through the interior surface and the exterior surface of the hat, and coupling the brace to the bracket with a fastener that extends through the interior surface and the exterior surface of the hat.

Various other features, objects, and advantages will be made apparent from the following description taken together with the drawings.

BRIEF DESCRIPTION OF THE DRAWINGS

The present disclosure is described with reference to the following Figures. The same numbers are used throughout the Figures to reference like features and like components.

DETAILED DISCLOSURE

The present inventor has observed that conventional attachment systems for coupling accessories to hats do not adequately support the accessories. For instance, some conventional systems do not securely couple the accessories to the hat and accordingly, the accessories inadvertently move, such as flap or rotate, relative to the hat during use or fall off the hat. Thus, the hat and the accessories are not comfortable to wear (e.g., the hat and accessories create discomfort). As such, the present inventor has endeavored to develop improved hats and accessory attachment systems that securely couple or attach accessories to hats and minimize discomfort when the hat and accessories are worn. Accordingly, the present inventor has developed the hats, hat assemblies, and attachment systems of the present disclosure. The hats and attachment systems of the present disclosure permit various types of accessories to be easily coupled to and decoupled from the hat. Furthermore, the hats and attachment systems of the present disclosure securely and adequately support the accessories. For example, as will be described in greater detail hereinbelow, the attachment systems of the present disclosure provide a stable support structure for coupling accessories to the hat and in certain examples, the attachment system advantageously increases the overall rigidity of the hat and decreases discomfort when the hat and accessories are worn.

Figure 1:
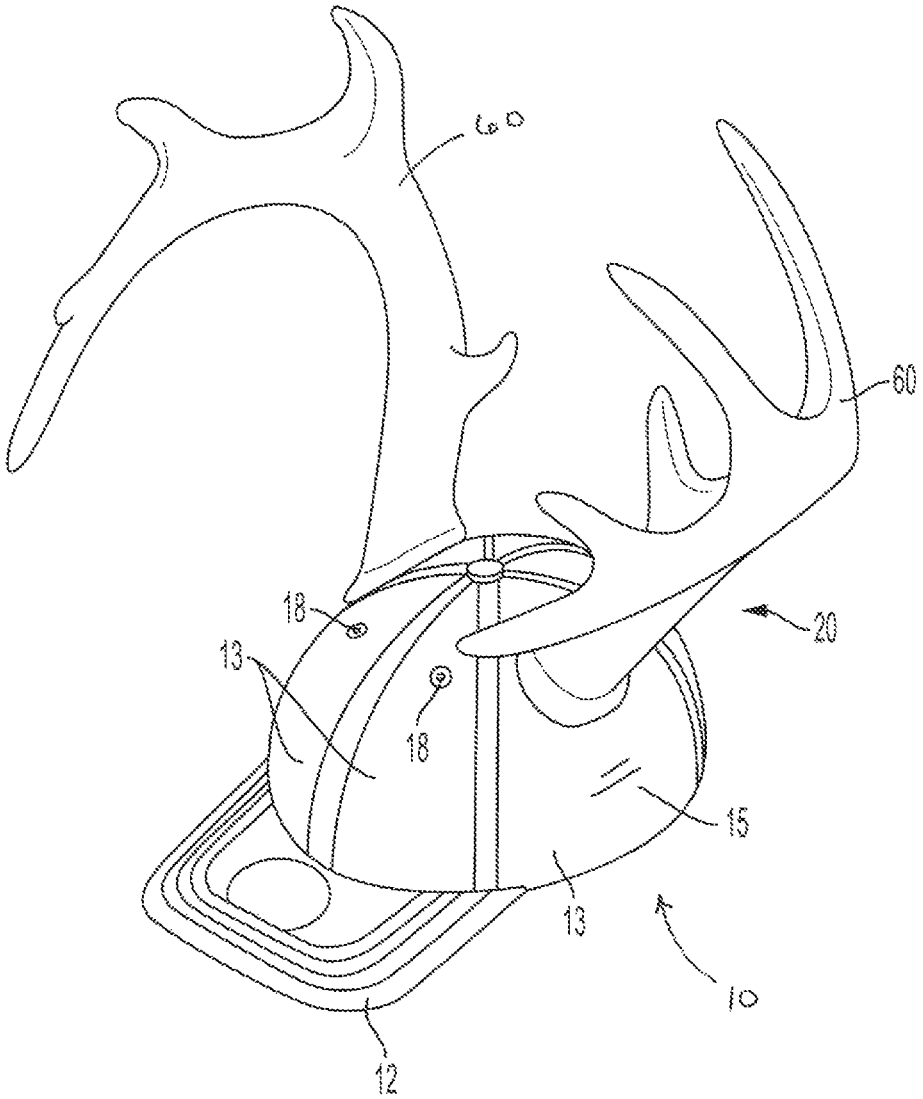
FIG. 1 is a perspective view of an example hat and an example attachment system of the present disclosure.
Figure 2:
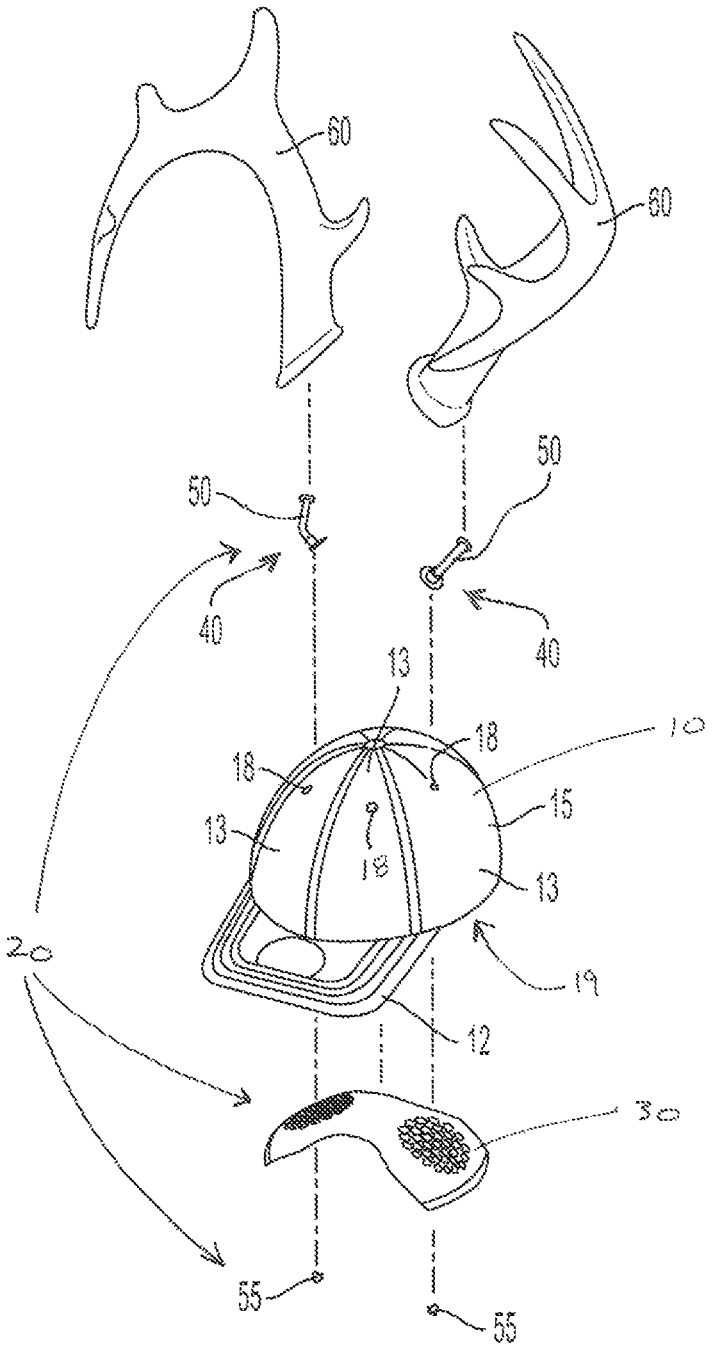
FIG. 2 is an exploded view of the hat and the attachment system shown in FIG. 1.
Figure 3:
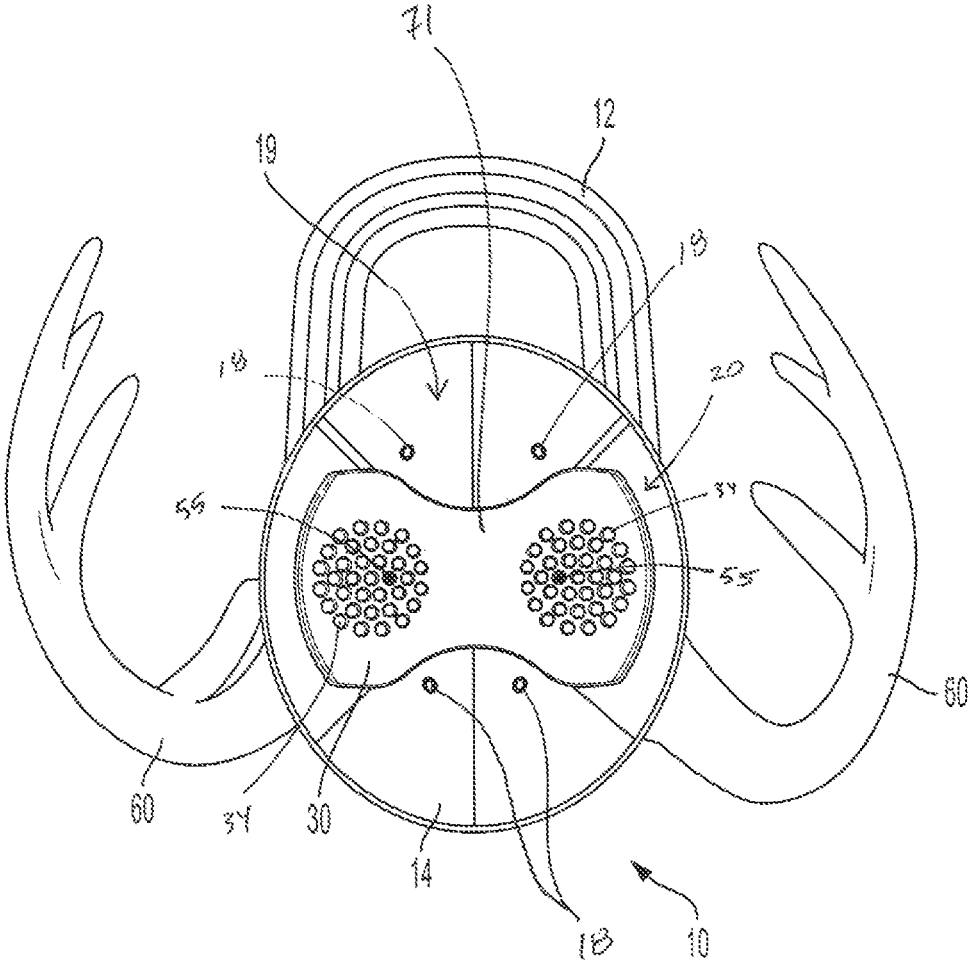
FIG. 3 is a bottom-up plan view of the hat and the attachment system shown in FIG. 1.
Figure 14:
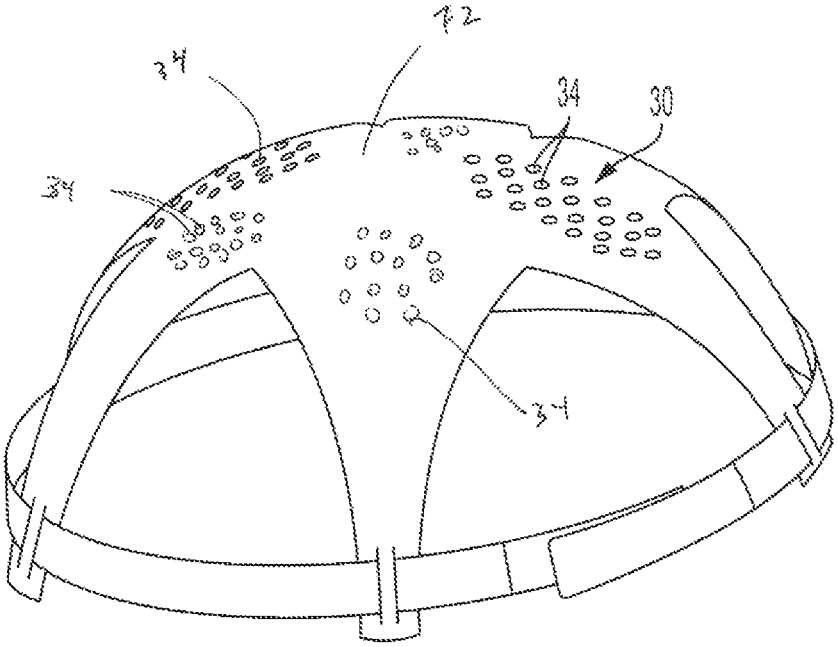
FIG. 14 is a perspective view of an another example of the brace.

FIGS. 1-3 depict an example hat 10 with an example attachment system 20 (see also FIG. 14) of the present disclosure that couples one or more accessories 60 (e.g., faux deer antlers) to the hat 10. The hat 10 includes a brim 12 and multiple panels 13 that form an overall interior surface 14 (FIG. 3) and an opposite, exterior surface 15 of the hat 10. When the hat 10 is worn by a user, the interior surface 14 (FIG. 14) is next to the head of the user and the exterior surface 15 is exposed and visible. The hat 10 has a plurality of eyelets 18, and each eyelet 18 extends through a panel 13 and the surfaces 14, 15 of the hat 10. The panels 13 of the hat 10 are curved such that that the interior surface 14 is curved and the hat 10 defines a cavity 19 (FIG. 4) in which the head of the user is received. The shape of the cavity 19 corresponds to the shape and/or contours of the user's head. In certain examples, the cavity 19 has a partial spherical shape (e.g., the cavity 19 has a half-spherical shape). In certain examples, the panels 13 have a concave shape such that the interior surface 14 is concave.

The system 20 includes a brace 30 positioned in the cavity 19 (FIG. 3) along the interior surface 14 of the hat 10, one or more brackets 40 on the exterior surface 15 of the hat 10, and a pair of fasteners 55 (e.g., screw, bolt, pin) that couple the brace 30 to the bracket(s) 40 via eyelets 18. That is, when the system 20 is coupled to or installed on the hat 10, the brace 30 along the interior surface 14 is coupled to the brackets 40 on the exterior surface 15 with the fasteners 55. Accordingly, a panel 13 of the hat 10, and the surfaces 14, 15 of the hat 10, are sandwiched between the brace 30 and the brackets 40. The components of the system 20 is described further herein below. The system 20 can be used with any type of hat, such as hardhats, baseball hats, and fashion hats. In certain examples, the number of brackets 40 and fasteners 55 can vary. In one non-limiting example the system 20 includes three brackets 40 and three fasteners 55. In certain examples, the fastener 55 punctures a hole in the hat 10 that is separate from the eyelet 18. In this example, the fastener 55 extends through the punctured hole to thereby couple the bracket 40 to the brace 30.

Figure 4:
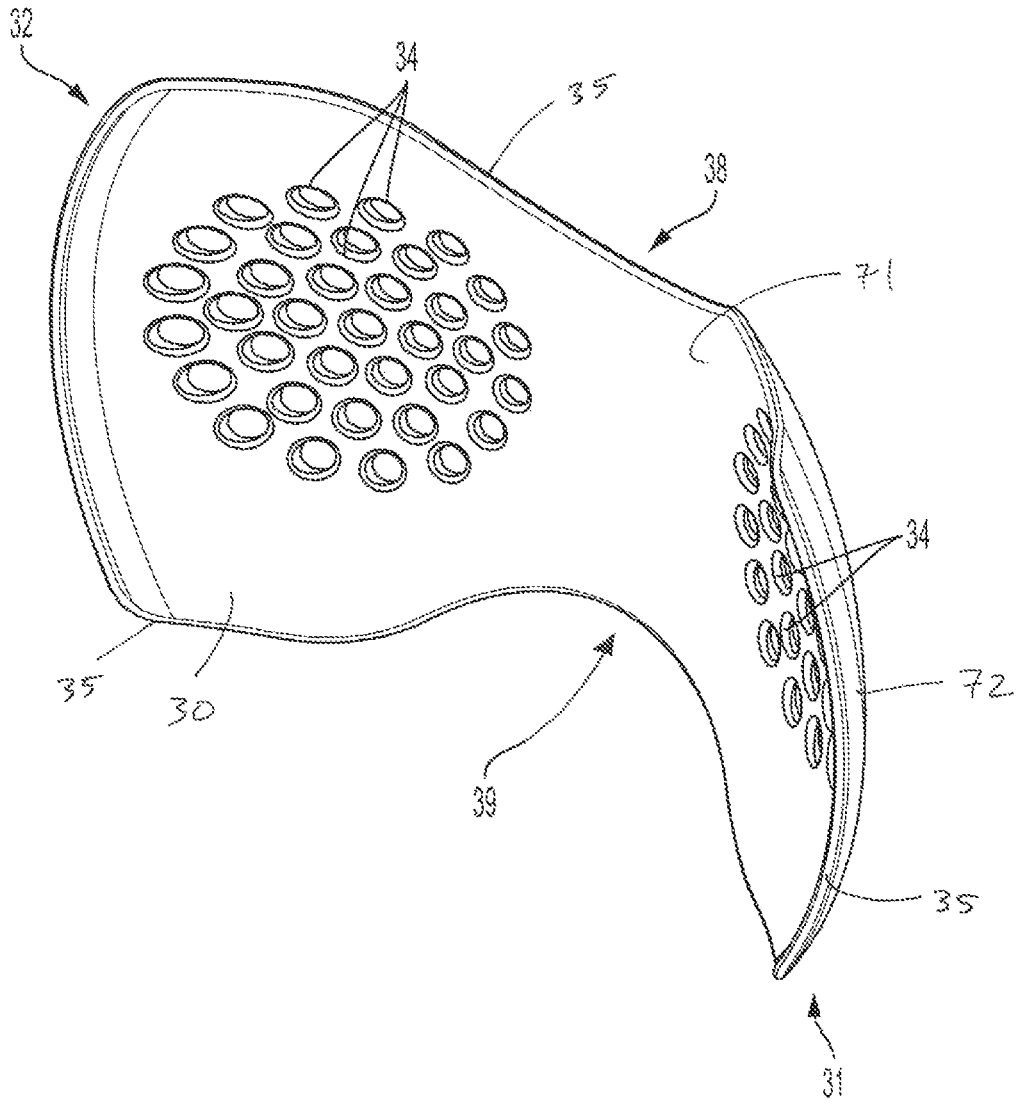
FIG. 4 is a perspective view of an example brace.
Figure 5:
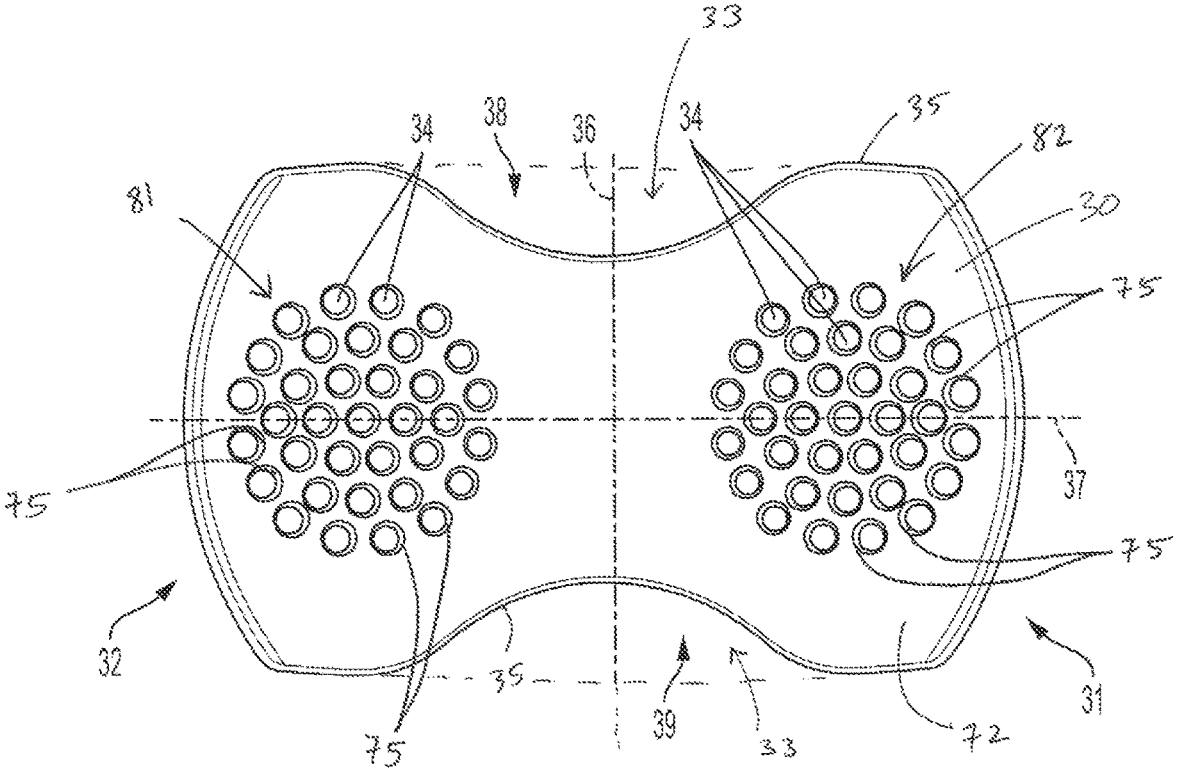
FIG. 5 is a bottom-up plan view of the brace shown in FIG. 4.
Figure 6:
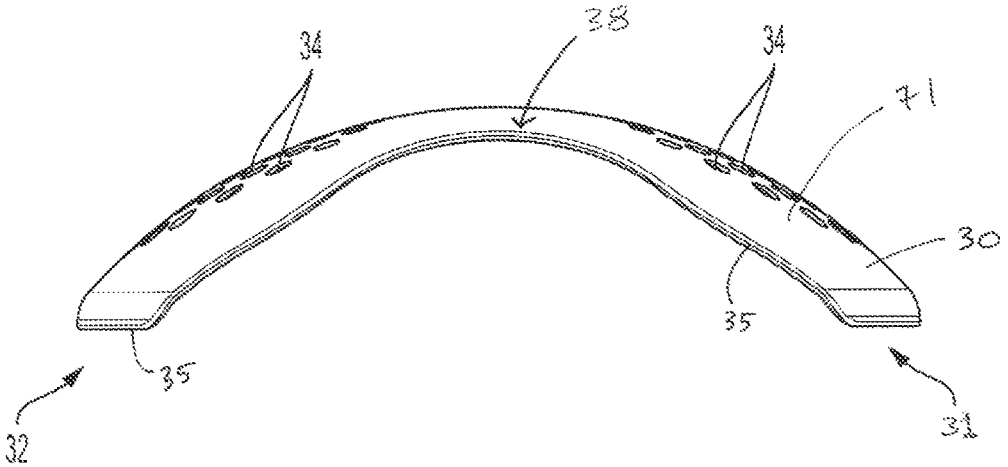
FIG. 6 is a side view of the brace shown in FIG. 4.

FIGS. 4-6 depict an example brace 30 of the system 20. The brace 30 has opposite ends 31, 32, opposite sides 38, 39, and a plurality of holes 34. The brace 30 has a lateral axis 36 and a longitudinal axis 37 (FIG. 5). The shape of the brace 30 is mirrored laterally across the lateral axis 36 of the brace 30 and longitudinally across the longitudinal axis 37 of the brace 30. The brace 30 has a perimeter edge 35, and the sides 38, 39 define cutouts 33 such that the ends 31, 32 are wider than the middle section of the brace 30. The ends 31, 32 are bent or curved inwardly toward each other and the lateral axis 36. The axes 36, 37 each bisect the brace 30, respectively. The sides 38, 39 are bent or curved inwardly toward each other and the longitudinal axis 37. Accordingly, the brace 30 has a concave bottom surface 71 and a convex top surface 72 and the brace 30 corresponds to the shape or contours of the user's head and the hat 10. In certain examples, the shape of the brace 30 preferably closely matches or corresponds to the interior surface 14 of the hat 10 and/or the contours of the user's head to thereby eliminate or minimize discomfort when the hat 10 and the system 20 are won by the user. In other examples, the shape of the brace 30 differs from that shown in FIGS. 4-6. The brace 30 is made from any suitable material, such as plastic, metal, and fabric. The brace 30 increases the rigidity of the hat 10.

The brace 30 has a plurality of holes 34 that extend between the top and bottom surfaces 71, 72 of the brace 30. When the system 20 is coupled to the hat 10, the fasteners 55 (FIG. 3) are received into holes 34 that align with the eyelets 18 or another hole (not shown) in the hat 10. In the example depicted in FIG. 4-6, the holes 34 are arranged (e.g., clustered) together in two separate sections of the brace 30. That is, the holes 34 are arranged in a first set of holes 34 (see arrow 81 on FIG. 5) and a second set of holes 34 (see arrow 82 on FIG. 5) that is separated from the first set of holes 34 (see arrow 81 on FIG. 5). The holes 34 in each set of holes (see arrows 81, 82) are arranged in linear rows that are staggered or offset relative to adjacent rows, and the brace 30 can be moved (e.g., translated along the hat 10, rotated relative the hat 10) such that at least one hole 34 from each set of holes (see arrows 81, 82) align with the eyelets 18 (FIG. 2). Accordingly, the brace 30 can be used with a variety of different hats 10 that may position the eyelets 18 in different positions (e.g., spacing between eyelets 18 may vary between different hats 10). The inclusion of multiple holes 34 increases the number of different hats 10 the system 20 can be coupled to. The brace 30 can be cut or trimmed such that the user may customize the brace to file the hat 10. The holes 34 also function as vents thereby allowing heat to pass from the user's head through the brace 30. In certain examples, the holes 34 in each set of holes 34 (see arrow 81, 82) are arranged in generally circular pattern such that the sets of holes (see arrows 81, 82) each have a circular shape.

Figure 7:
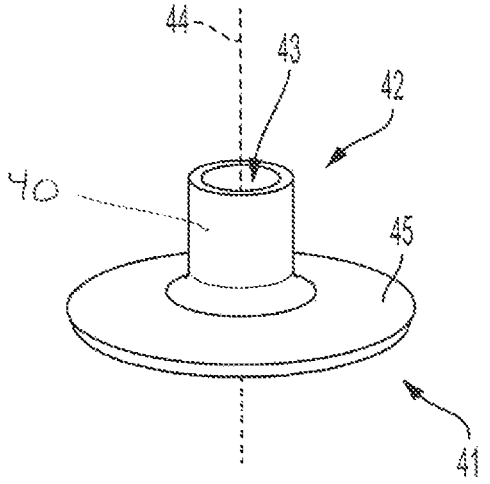
FIG. 7 is a perspective view of an example bracket.
Figure 8:
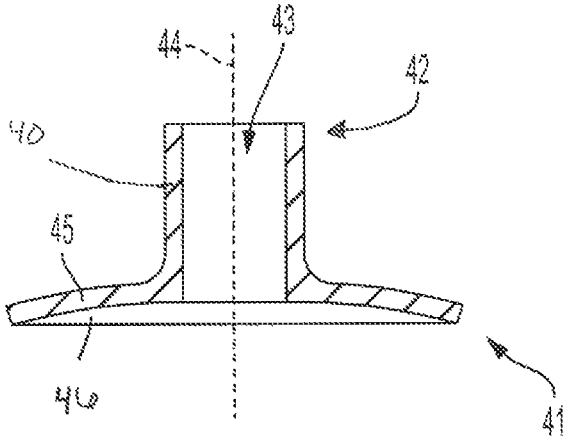
FIG. 8 is a cross-sectional view of the bracket shown in FIG. 7.
Figure 9:
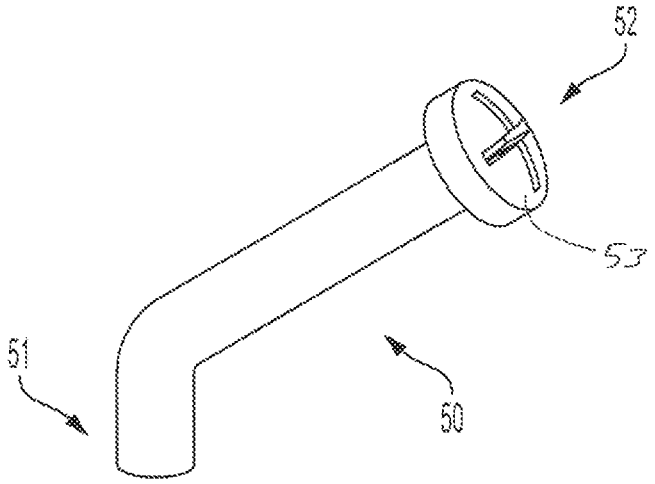
FIG. 9 is a perspective view of an example arm.

FIGS. 7-9 depict an example bracket 40 of the system 20. The bracket 40 has a first end 41, an opposite second end 42, and bore 43 extending along an axis 44 between the ends 41, 42. The first end 41 includes a flange 45 that radially outwardly extends from the axis 44. In certain examples, the flange 45 is curved or domed and has a concave surface 46 that corresponds to the curvature of the exterior surface 15 (FIG. 2) of the hat 10. When the system 20 is coupled to the hat 10, the bore 43 of the bracket 40 is aligned with an eyelet 18 or a hole (not shown). That is, the first end 41 of the bracket 40 is positioned along the exterior surface 15 of the hat 10 (FIG. 2) such that the bore 43 aligns with an eyelet 18 (FIG. 2). In certain examples, two brackets 40 are used to connect two accessories 60 to the hat 10 and the axis 44 of each bore 43 for each bracket 40 extends transverse relative to each other. In certain examples, more than one bracket 40 is used to connect a single accessory 60 to the hat 10.

Figure 10:
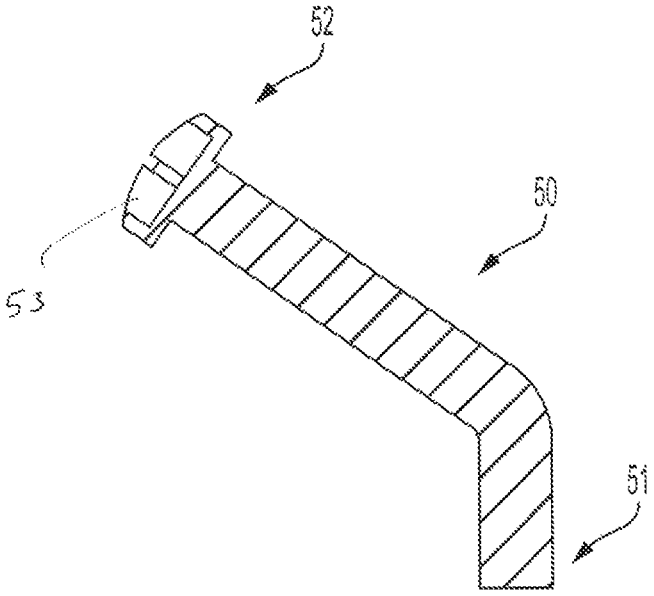
FIG. 10 is a cross-sectional view of the arm shown in FIG. 9.

FIGS. 9-10 depict an example removable arm 50 of the bracket 40. The arm 50 has a first end 51 and an opposite second end 52. When the system 20 is coupled to the hat 10, the first end 51 of the arm 50 is in the bore 43 of the bracket 40 and the second end 52 extends away from the hat 10. Accordingly, the accessory 60 (FIG. 2) can be attached to the second end 52 of the arm 50 such that the accessory 60 is coupled to the hat 10. In another example, the second end 52 of the arm 50 is embedded in or integral with the accessory 60 such that the first end 51 of the arm 50 extends from the accessory 60 and can be received into the bore 43 of the bracket 40. The shape of the arm 50 can vary, and the example arm 50 depicted in FIG. 9 is bent at an angle such that the first end 51 extends transverse to the second end 52. The first end 51 remains in the bore 43 of the bracket 40 due to friction between these components (e.g., the first end 51 has a diameter slightly larger than the diameter of the bore 43, one of the first end 51 and the bore 43 is tapered). In other examples, the bore 43 has threads that engage with threads on the first end 51. In still other examples, the bracket 40 has a set screw that engages the first end 51. In certain examples, the second end 52 has an enlarged head 53 that resists movement of the accessory 60 away from the arm 50. The arm 50 can be made of any suitable material such as plastic, metal, and the like. In certain examples, the arm 50 can be threaded. In other examples, the arm 50 is integrally formed with the bracket 40.

Figure 11:
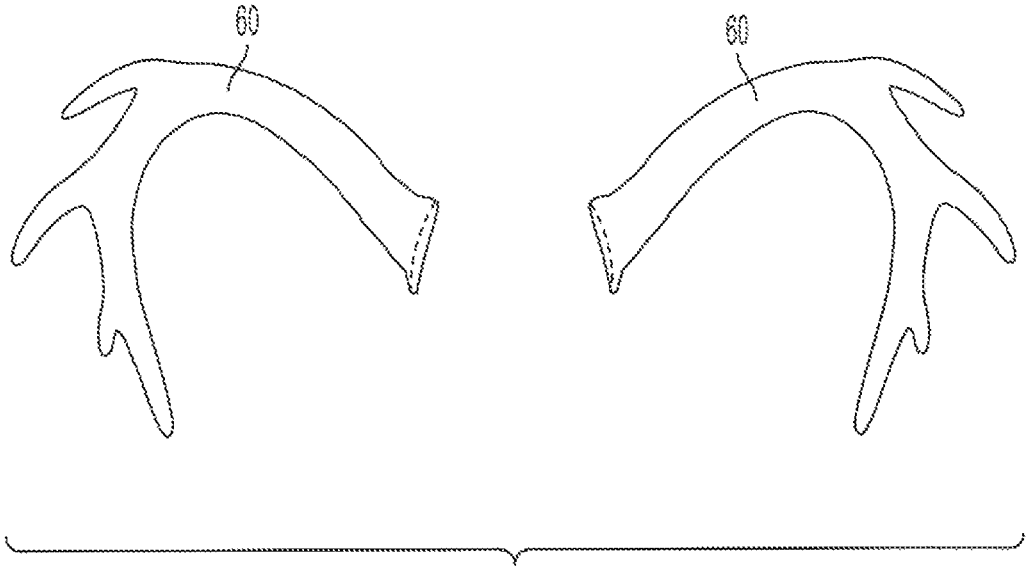
FIG. 11 is a perspective view of example accessories.
Figure 12:
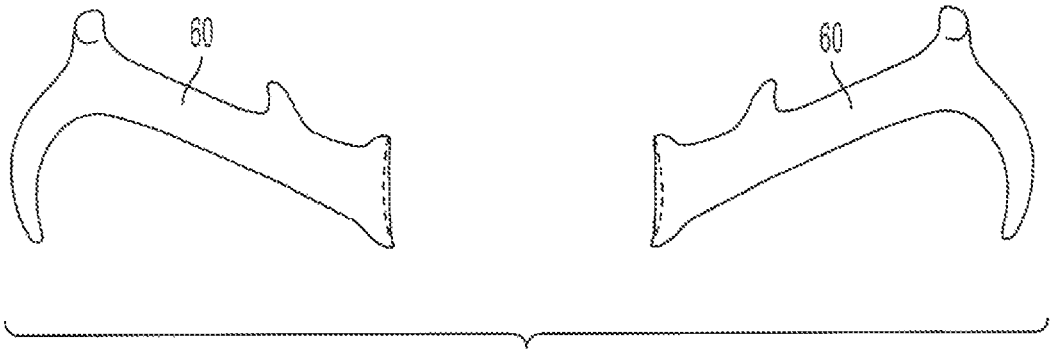
FIG. 12 is a perspective view of other example accessories.

FIGS. 11-12 depict example accessories 60 of the present disclosure. The size, shape, and function of the accessories 60 can vary. For example, the accessories 60 can be shaped to be features of the animals (e.g. deer antlers, ram horns, bear ears, insect antennas, elephant trunks), college and professional sport teams logos and items, objects (e.g. football, pin-wheels, holiday-themed items, pop-culture characters, flags), identification items (e.g. names, text), and/or functional objects (e.g. lights, cameras, camera mounts, solar panels, speakers, headphones). The accessories 60 can have holes in which the second ends 52 of the arms 50 are received. In other examples, the accessories 60 are formed from elastic materials that tightly hug or contact the arms 50. While the accessories 60 depicted in FIGS. 11-12 depict two separated accessories, a single larger accessory 60 can be coupled to the hat 10 with two brackets 40.

Figure 13:
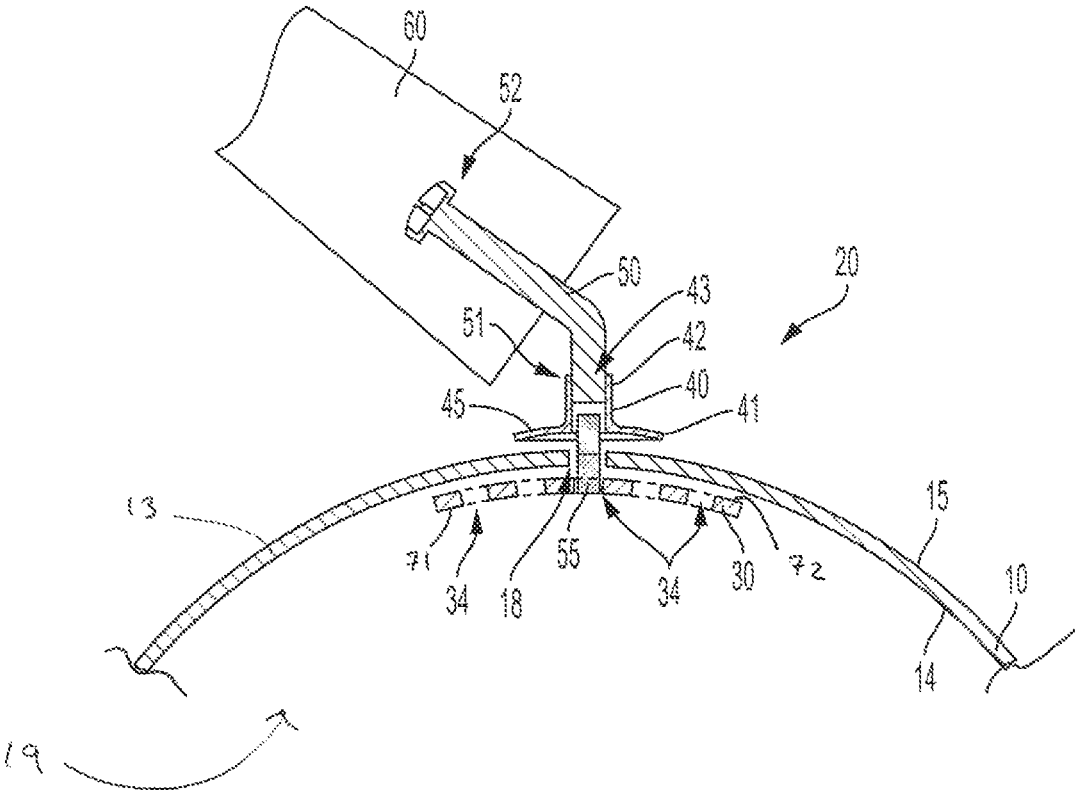
FIG. 13 is a cross-sectional view of an example attachment system coupled to the hat.

Referring now to FIG. 13, coupling of the system 20 to the hat 10 is shown in greater detail. Note that that while FIG. 13 depicts small gaps or spaces between components for clarity, when the system 20 is coupled to the hat 10 the components will contact one another (e.g., the bracket 40 will contact the hat 10 and the brace 30 will contact the hat 10). Also note that FIG. 13 depicts one point of connection of the system 20 to the hat 10. However, a person having ordinary skill in the art will recognize that the example coupling sequence described herein below can be used at multiple points of connection between the system 20 and the hat 10 such that the system 20 is securely coupled to the hat 10 (e.g., FIGS. 1-3 depict a system 20 with two points of connection to the hat 10).

To couple the system 20 to the hat 10, the user places the brace 30 into the cavity 19 of the hat 10 and along the interior surface 14 such that one of the holes 34 in the brace 30 aligns with an eyelet 18. The bracket 40 is then positioned onto the exterior surface 15 of the hat 10 such that the first end 41 of the bracket 40 is adjacent to the exterior surface 15 of the hat 10 and the bore 43 of the bracket 40 aligns with the eyelet 18. The user then inserts a fastener 55 (e.g., a screw, bolt, pin) into and through the hole 34 such that the fastener 55 extends through the eyelet 18 and the surfaces 14, 15 of the hat 10, projects or extends away from the exterior surface 15 of the hat 10, and is received into the bore 43 of the bracket 40. The fastener 55 is securely retained in the hole 34 by friction between the fastener 55 and the brace 30 and the fastener 55 is securely retained in the bore 43 by friction between the fastener 55 and the bracket 40. In other examples, the fastener 55 has threads that engage with threads in the hole 34 and/or the bore 43. In still other examples, the fastener 55 has an enlarged head that is larger than the hole 34 such that the fastener 55 cannot be completely moved through the hole 34. In this example, a concentric groove 75 (FIG. 5) is around the hole 34 such that the enlarged head of the fastener 55 is recessed into the brace 30 so as to not cause the user discomfort. When the brace 30 is coupled to the bracket 40, the brace 30 prevents twisting or rotation of the bracket 40 or the panel 13 caused by the weight of the accessory 60. Furthermore, when two or more bracket 40 are connected to the same brace 30, the brace 30 prevents the twisting or rotation of the brackets 40 or the panels 13 caused by the weight of the accessories 60 and further prevents movement of the brackets 40 and/or the accessories 60 away from each other, respectively.

In another example, the fastener 55 extends away from the exterior surface 15 of the hat 10 such that the bracket 40 is then moved into engagement with the fastener 55. That is, the bore 43 is aligned with and receives the fastener 55. The fastener 55 is securely retained in the bore 43 by friction or with threads of the fastener 55 and the bore 43 that engage each other. As such, the bracket 40 and the brace 30 are coupled to each other and thereby sandwich the panel 13 and the surfaces 14, 15 of the hat 10 there between. In certain examples, the bracket 40 and the brace 30 can be moved or forced toward each other (e.g., further engagement of threads) such that the bracket 40 and the brace 30 tightly sandwich or compress the panel 13 of the hat 10.

In certain examples, once the bracket 40 is coupled to the brace 30, the first end 51 of the arm 50 is inserted into and secured in the bore 43 of the bracket 40. Accordingly, an accessory 60 is connected to the second end 52 of the arm 50. In other examples, the arm 50 is embedded in the accessory 60 such that the first end 51 of the arm 50 and the accessory 60 are coupled to the bracket 40 at the same time. In still other examples, the arm 50 is not removable from the bracket 40.

As noted above, the system 20, when coupled to the hat 10, provides a stable structure to which one or more accessories 60 can be coupled. In particular, the brace 30 extends between multiple brackets 40 and multiple eyelets 18 (or holes) such that the system 20 resists movement (e.g., pivoting) of the accessories 60 relative to the hat 10. The system 20 can also be configured to permit the accessories 60 to be easily coupled and decoupled from the system 20 without removing the entire system 20 from the hat 10. That is, in one example, the accessories 60 and the arms 50 are removed while the brackets 40 and the brace 30 remain coupled to the hat 10. Furthermore, the system 20 can be easily coupled and decoupled to the hat 10 damaging the hat 10.

The present inventor has contemplated that the system 20 can include any number of brackets 40 and accessories 60, and the system 20 may utilize any number of eyelets 18 (or holes) to secure the accessories 60 to the hat 10. (e.g., one eyelet is utilized, two eyelets are utilized as shown in FIGS. 1-3, three eyelets are utilized). The brace 30 can be shaped to extend to and between each connection point, eyelet 18, and bracket 40 utilized by the system 20. For example, the brace 30 depicted in FIGS. 2-3 extends between two connection points and FIG. 15 depicts an alternate example of the brace 30 that extends between more than two connection points and has more than two sets of holes 34. The present inventor has also contemplated that the system 20 can be coupled to the hat 10 at locations other than the eyelets 18, such as puncturing or creating a new hole in one of the panels 13. Furthermore, the present inventor has also contemplated that the brackets 40 and/or the brace 30 may include magnets such that the brace 30 and brackets 40 are coupled to each other and the hat 10 without the use of a fastener 55. Magnets may also be used to couple the accessory 60 to the bracket 40.

In certain examples, a method for attaching an accessory to a hat includes the steps of positioning a brace along an interior surface of the hat; positioning a bracket on an exterior surface of the hat; and coupling the brace to the bracket with a fastener that extends through the interior surface and the exterior surface of the hat.

In the present description, certain terms have been used for brevity, clarity, and understanding. No unnecessary limitations are to be inferred therefrom beyond the requirement of the prior art because such terms are used for descriptive purposes and are intended to be broadly construed. The different apparatuses, systems, and method steps described herein may be used alone or in combination with other apparatuses, systems, and methods. It is to be expected that various equivalents, alternatives and modifications are possible within the scope of the appended claims.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A system for coupling one or more accessories to a hat, the hat having an interior surface, an opposite exterior surface, a first eyelet, and a second eyelet, the system comprising:

a brace configured to extend along the interior surface of the hat, the brace having:

a first end and an opposite second end;

an axis extending along the brace between the first end and the second end;

a plurality of holes arranged into a first set of holes and a second set of holes, the first set of holes is spaced apart from the second set of holes, the first set of holes is centered on the axis and the second set of holes is centered on the axis;

a first bracket configured to be positioned along the exterior surface of the hat such that the first bracket aligns with the first eyelet of the hat;

a second bracket configured to be positioned along the exterior surface of the hat such that second bracket aligns with the second eyelet of the hat;

a first fastener configured to extend through the first eyelet and a hole of the first set of holes that aligns with the first eyelet to thereby couple the first bracket to the brace such that the accessory can be coupled to the first bracket and thereby supported on the hat; and a second fastener configured to extend through the second eyelet and a hole of the second set of holes that aligns with the second eyelet to thereby couple the second bracket to the brace such that another accessory or the accessory coupled to the first bracket can be coupled to the second bracket and thereby supported on the hat.

2. The system according to claim 1, wherein the first fastener and the second fastener each have an enlarged head that is recessed into the brace.

3. The system according to claim 1, wherein each bracket has a bore, and wherein each fastener is received in a hole in the brace and one of the bores to thereby couple the first and second brackets to the brace.

4. The system according to claim 3, wherein the bore extends along an axis, and wherein the each bracket has a radially extending flange configured to contact the exterior surface of the hat.

5. The system according to claim 4, wherein the flange has a flange surface shaped to correspond to curvature of the exterior surface and configured to contact the exterior surface.

6. The system according to claim 5, wherein the flange surface is a concave surface.

7. The system according to claim 1, wherein the first set of holes and the second set of holes collectively include four holes and wherein each hole is spaced apart from each other along the axis.

8. The system according to claim 7, wherein the axis is a first axis, and herein the brace further includes:

a first side and an opposite second side;

a second axis extending along the brace between the first side and the second side;

a first cutout defined in the first side and centered on the second axis; and a second cutout defined in the second side and centered on the second axis.

9. The system according to claim 7, wherein the axis is a first axis, and wherein the brace further includes a first side, an opposite second side, and a second axis extending along the brace between the first side and the second side; and wherein two holes of the four holes are offset from the second axis in a first direction that extends toward the first end from the second axis and the other two holes of the four holes are offset from the second axis in a second direction that extends toward the second end from the second axis.

10. The system according to claim 1, wherein the axis is a first axis, and wherein the brace further includes:

a first side and an opposite second side;

a second axis extending along the brace between the first side and the second side;

a first cutout defined in the first side and centered on the second axis; and a second cutout defined in the second side and centered on the second axis.

11. The system according to claim 1, wherein the brace has a bow-tie shape.

12. A system for coupling one or more accessories to a hat, the hat having an interior surface, an opposite exterior surface, a first eyelet, and a second eyelet, the system comprising:

a first bracket configured to be positioned along the exterior surface of the hat and aligned with the first eyelet;

a second bracket configured to be positioned along the exterior surface of the hat and aligned with the second eyelet, the second bracket is spaced apart from the first bracket;

a brace having:

a plurality of holes arranged into a first set of holes and a second set of holes, the first set of holes is spaced apart from the second set of holes;

a first end and an opposite second end;

a first side and an opposite second side;

a first axis extending along the brace between the first end and the second end;

a second axis extending along the brace between the first side and the second side;

a first cutout defined in the first side and centered on the second axis; and a second cutout defined in the second side and centered on the second axis;

a first fastener configured to extend through the hole of the first set of holes that is aligned with the first eyelet and the first eyelet to thereby couple the brace to the first bracket such that the accessory can be coupled to the first bracket and supported on the hat; and a second fastener configured to extend through the hole of the second set of holes that is aligned with the second eyelet and the second eyelet to thereby couple the brace to the second bracket such that another accessory or the accessory coupled to first bracket can be coupled to the second bracket and supported on the hat.

13. The system according to claim 12, wherein the brace has a bow-tie shape.

14. The system according to claim 12, wherein the brace is configured to be moveable along the interior surface such that a hole of the first set of holes is moved into alignment with the first eyelet and a hole of the second set of holes is moved into alignment with the second eyelet.

* * * * *